US006257520B1

(12) United States Patent
Fujikura

(10) Patent No.: US 6,257,520 B1
(45) Date of Patent: Jul. 10, 2001

(54) NONCONTACT WEB TRANSPORTING APPARATUS

(75) Inventor: Daisuke Fujikura, Minami-Ashigara (JP)

(73) Assignee: Fujii Photo Co., Ltd., Kanagawa (JP)

( * ) Notice: Subject to any disclaimer, the term of this patent is extended or adjusted under 35 U.S.C. 154(b) by 0 days.

(21) Appl. No.: 09/588,239

(22) Filed: Jun. 6, 2000

(30) Foreign Application Priority Data

Jun. 8, 1999 (JP) ..... 11-161234

(51) Int. Cl.[7] ..... B65H 23/32; B65H 43/08

(52) U.S. Cl. ..... 242/615.12; 226/23; 34/466; 242/365.6; 242/615.21

(58) Field of Search ..... 226/21, 23; 242/365.6, 242/615.12, 615.21; 34/451, 462, 466

(56) References Cited

U.S. PATENT DOCUMENTS 1,630,713 * 5/1927 Meyer ..... 242/615.12
2,659,225 * 11/1953 Ewing ..... 242/365.6 X
3,626,603 * 12/1971 Breyer ..... 242/615.12 X
3,912,144 * 10/1975 Arseneault et al. ..... 242/615.12 X
4,506,841 * 3/1985 Hood ..... 242/615.12
5,520,317 * 5/1996 Eckert et al. ..... 242/615.12
6,105,899 * 8/2000 Harris ..... 226/23 X

FOREIGN PATENT DOCUMENTS 48-44151 12/1973 (JP) .
61-2676 1/1986 (JP) .
6-144663 5/1994 (JP) .

* cited by examiner

*Primary Examiner*—Michael R. Mansen
(74) *Attorney, Agent, or Firm*—Sughrue, Mion, Zinn, Macpeak & Seas, PLLC

(57) ABSTRACT

A tension determining apparatus that is arranged above cylindrical air chambers determines tensions at both edges of a web before the web enters helical routes of the cylindrical air chambers. Middle direction changing air chambers among three direction changing air chambers arranged in a row are inclined by a predetermined angle according to the difference between the tensions at both edges of the web. Therefore, a snaking and a bias of the web are reduced, and the web can run stably.

4 Claims, 9 Drawing Sheets

NONCONTACT WEB TRANSPORTING APPARATUS

BACKGROUND OF THE INVENTION

1. Field of the Invention

The present invention relates generally to a noncontact web transporting apparatus, and more particularly to a noncontact web transporting apparatus that transports a web along helical routes without coming into contact with the web while reducing a bias and a snaking of the web to stabilize the transportation of the web.

2. Description of Related Art

A noncontact transporting apparatus transports a web along helical routes without coming into contact with the web, and it comprises at least two cylindrical air chambers that support the web that is running along the helical routes through air films and direction changing rollers that the web 10 enters and leaves the helical routes from and for as disclosed in Japanese Patent Publication No. 48-44151.

It is important to stably transport the web along the helical routes. Japanese Utility Model Publication No. 61-2676 and Japanese Patent Provisional Publication No. 6-144663 disclose noncontact transporting apparatuses in which direction changing rollers can incline and the position of the running web is determined and the direction changing rollers are inclined so that the web is always positioned in the middle to stably transport the web.

In the noncontact transporting apparatuses disclosed in Japanese Utility Model Publication No. 61-2676 and Japanese Patent Provisional Publication No. 6-144663 , however, the direction changing rollers are always inclined, and thus it shakes the web and causes a snaking of the web.

SUMMARY OF THE INVENTION

In view of the foregoing, it is an object of the present invention to provide a noncontact web transporting apparatus that reduces a snaking and a bias of a web to stably transport the web.

To achieve the above-mentioned object, the present invention is directed to a noncontact web transporting apparatus, comprising: at least two cylindrical air chambers which support a web running along helical routes through air films without coming into contact with the web by jetting air from jets formed in peripheries of the at least two cylindrical air chambers, the at least two cylindrical air chambers being substantially arranged parallel; direction changing air chambers which support the web through air films by jetting air from jets formed in peripheries of the direction changing air chambers to change running directions of the web when the web enters and leaves the helical routes of the at least two cylindrical air chambers, the direction changing air chambers being arranged in rows at both ends of the at least two cylindrical air chambers; a tension determining device which determines tensions at both edges of the web before the web enters the helical routes of the at least two cylindrical air chambers, the tension determining device being arranged above the at least two cylindrical air chambers; and an inclining device which inclines the direction changing air chambers according to determination results of the tension determining device.

According to the present invention, the tension determining device provided above the cylindrical air chambers determines the tensions at both edges of the web before the web enters the helical routes of the cylindrical air chambers. Then, the inclining device inclines the direction changing air chambers by the predetermined angle according to the determination results. The angle of inclination of the direction changing air chambers is kept while the web runs. Therefore, a snaking and a bias of the web are reduced, and the web can run stably.

To achieve the above-mentioned object, the present invention is directed to a noncontact web transporting apparatus, comprising: at least two cylindrical air chambers which support a web running along helical routes through air films without coming into contact with the web by jetting air from jets formed in peripheries of the at least two cylindrical air chambers, the at least two cylindrical air chambers being substantially arranged parallel; direction changing air chambers which support the web through air films by jetting air from jets formed in peripheries of the direction changing air chambers to change running directions of the web when the web enters and leaves the helical routes of the at least two cylindrical air chambers, the direction changing air chambers being arranged in rows at both ends of the at least two cylindrical air chambers, each of the rows having three direction changing air chambers; a tension determining device which determines tensions at both edges of the web before the web enters the helical routes of the at least two cylindrical air chambers, the tension determining device being arranged above the at least two cylindrical air chambers; and an inclining device which inclines a middle direction changing air chamber in each of the rows of the three direction changing air chambers according to determination results of the tension determining device.

According to the present invention, the tension determining device provided above the cylindrical air chambers determines the tensions at both edges of the web before the web enters the helical routes of the cylindrical air chambers. Then, the inclining device inclines the middle direction changing air chambers by the predetermined angle according to the determination results. The angle of inclination of the direction changing air chambers is kept while the web runs. Therefore, a snaking and a bias of the web are reduced, and the web can run stably.

The cylindrical air chambers are preferably enclosed by partitions separately, and L/A is preferably within the range between 0.1 and 2.0, where A is a cross-sectional area of spaces enclosed by the partitions and L is a length of the cylindrical air chambers.

According to the present invention, the temperature and the humidity of the air for drying the web can be easily controlled by enclosing the cylindrical air chambers with the partitions. If L/A is high, the spaces are large, and thus the apparatus cost is high and the space efficiently is low. Meanwhile, if L/A is high, the flow speed of return air is high and it causes a bias and a snaking of the web. L/A is preferably within the range between 0.1 and 2.0 and is more preferably within the range between 0.2 and 1.5.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
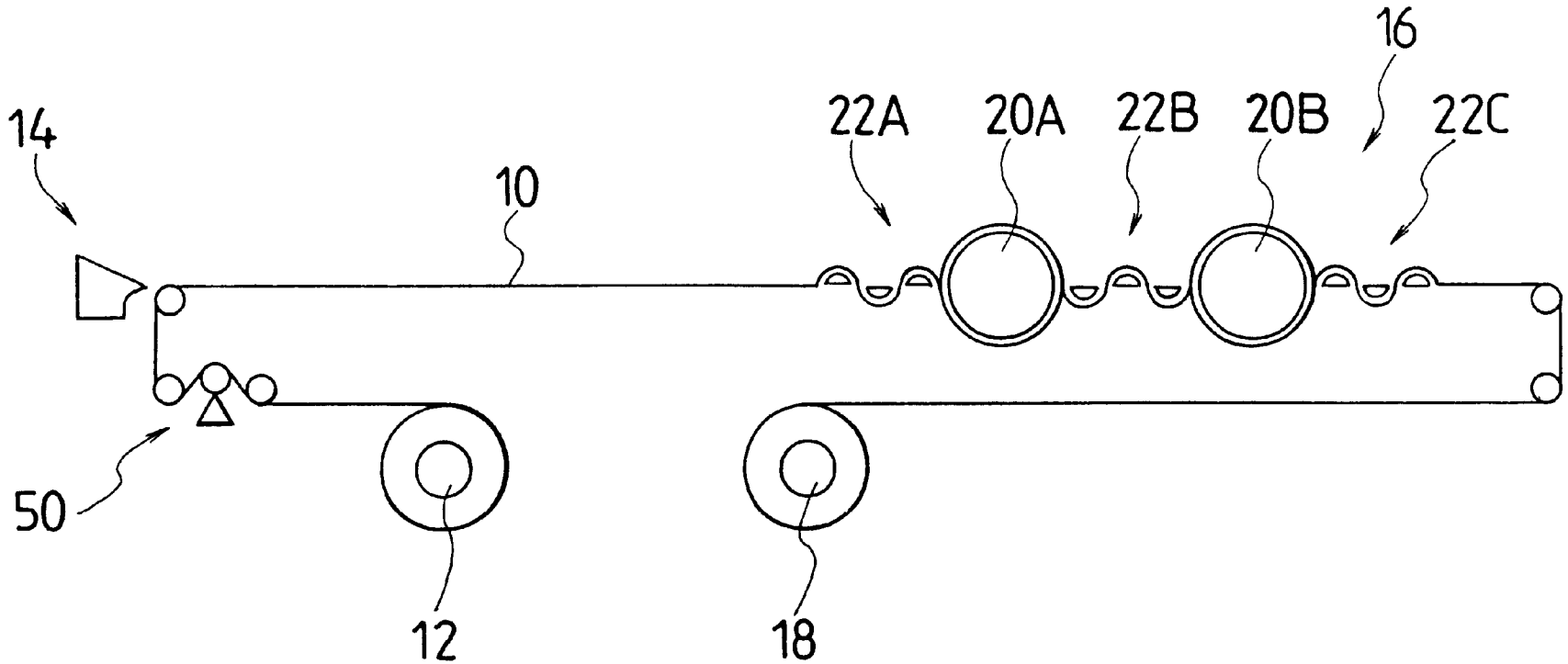
FIG. 1 is an explanation drawing showing the whole structure of a coating and drying apparatus for a photosensitive material in which a noncontact transporting apparatus according to an embodiment of the present invention is incorporated.

FIG. 1 is an explanation drawing showing the whole structure of a coating and drying apparatus for a photosensitive material in which a noncontact transporting apparatus according to an embodiment of the present invention is incorporated.

As shown in FIG. 1, a web 10 to be coated with the photosensitive material is wound on a sending-out roller 12, and is sent out from the sending-out roller 12 by a sending-out apparatus (not shown). The web 10 sent out from the sending-out roller 12 is coated with the photosensitive material by a coating apparatus 14, and then is led to the noncontact transporting apparatus 16 according to the present invention. The photosensitive material is dried while the web 10 is transported by the noncontact transporting apparatus 16 without being contacted with, and then the web 10 is taken up on a take-up roller 18 by a take-up apparatus (not shown).

Figure 2:
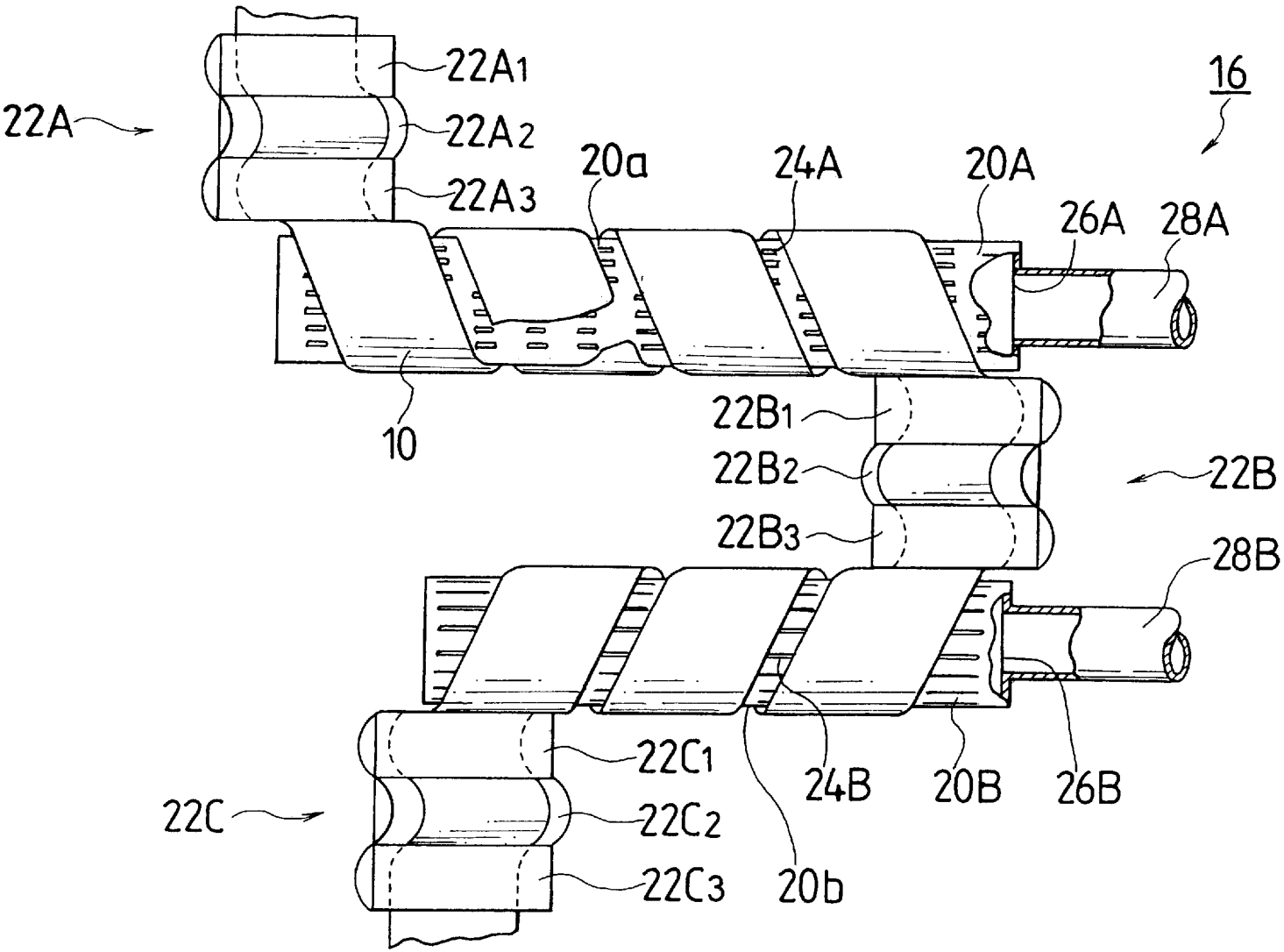
FIG. 2 is a plan view showing the structure of the noncontact transporting apparatus according to a first embodiment.

FIG. 2 is a plan view showing the structure of the noncontact transporting apparatus 16 according to a first embodiment of the present invention, and the noncontact transporting apparatus 16 has two air chambers for changing directions of the web 10 in FIG. 2. As shown in FIG. 2, the noncontact transporting apparatus 16 comprises the two cylindrical air chambers 20A and 20B that are substantially arranged parallel and three direction changing units 22A, 22B and 22C arranged on the upper side of the cylindrical air chamber 20A, between the cylindrical air chambers 20A and 20B and on the lower side of the cylindrical air chamber 20B, respectively, in FIG. 2.

The two cylindrical air chambers 20A and 20B are cylindrically formed, and are arranged parallel and horizontally at a predetermined interval. A number of air jets 24A and 24B that are holes or slits are formed in the peripheries of the cylindrical air chambers 20A and 20B. Air supply ports 26A and 26B are formed in one end surface of the cylindrical air chamber 20A and one end surface of the cylindrical air chamber 20B, respectively; and blast pipes 28A and 28B are connected with the air supply ports 26A and 26B, respectively. Air adjusted and cleaned to temperature and humidity conditions required at a drying process by an ordinal air source for drying (not shown) such as a blower, a filter, an air heater and a dehumidifier is supplied to the cylindrical air chambers 20A and 20B through the blast pipes 28A and 28B and the air supply ports 26A and 26B. Then, the air is jetted to spaces between the web 10 and the peripheries 20*a* and 20*b* of the cylindrical air chambers 20A and 20B, and is discharged to the atmosphere through the gaps between turns of the web 10 after performing a supporting and drying function for the web 10.

The web 10 is helically wound around the cylindrical air chambers 20A and 20B with its surface to be dried inside, and is transported along predetermined helical routes while the spaces (air films) are formed between the web 10 and the peripheries 20*a* and 20*b* by the pressure of the air jetted from the air jets 24A and 24B.

The three direction changing units 22A, 22B and 22C change the running directions of the web 10 when the web 10 enters the helical route of the cylindrical air chamber 20A, when the web 10 leaves the helical route of the cylindrical air chamber 20A and it enters the helical route of the cylindrical air chamber 20B and when the web 10 leaves the helical route of the cylindrical air chamber 20B, respectively. Since the direction changing units 22A, 22B and 22C are constructed the same, the structure of only the direction changing unit 22B between the cylindrical air chambers 20A and 20B will be described, and the other direction changing units 22A and 22C will not be described.

Figure 3:
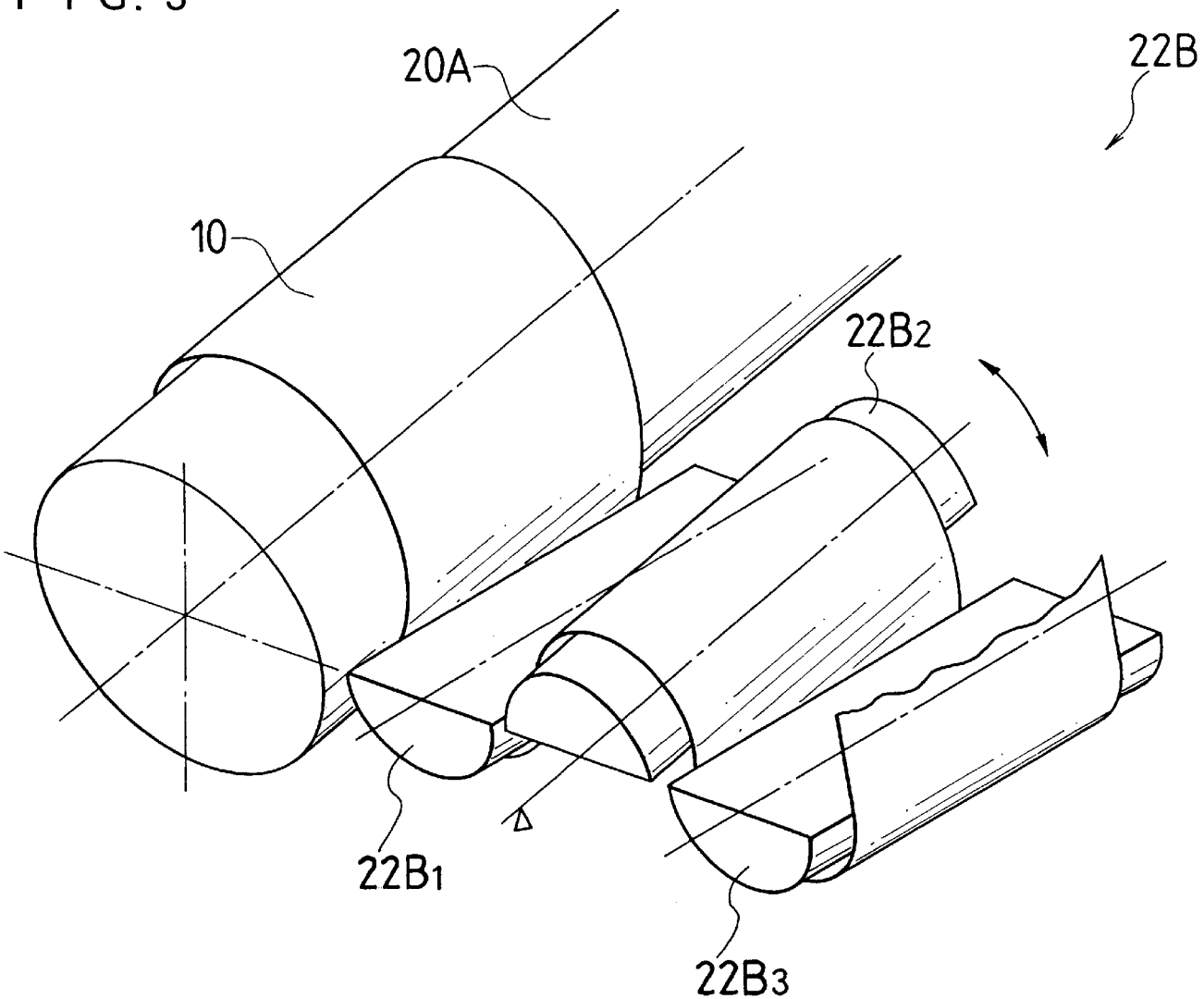
FIG. 3 is a perspective view showing the structure of a direction changing unit.

As shown in FIG. 3, the direction changing unit 22B comprises three direction changing air chambers $\mathbf{22B_1}$, $\mathbf{22B_2}$ and $\mathbf{22B_3}$ arranged in a row. The direction changing air chambers $\mathbf{22B_1}$, $\mathbf{22B_2}$ and $\mathbf{22B_3}$ are cylindrically formed with their sections being semicircles, and a number of air jets that are holes or slits (not shown) are formed in the arc peripheries of the direction changing air chambers $\mathbf{22B_1}$, $\mathbf{22B_2}$ and $\mathbf{22B_3}$. Air supply ports (not shown) are formed in one end surface of the direction changing air chambers $\mathbf{22B_1}$, one end surface of the direction changing air chamber $\mathbf{22B_2}$ and one end surface of the direction changing air chamber $\mathbf{22B_3}$; and blast pipes (not shown) are connected with the air supply ports. Air adjusted and cleaned to the temperature and humidity conditions required at the drying process by the ordinal air source for drying (not shown) is supplied to the direction changing air chambers $\mathbf{22B_1}$, $\mathbf{22B_2}$ and $\mathbf{22B_3}$ through the blast pipes and the air supply ports. Then, the air is jetted to spaces between the web 10 and the arc peripheries of the direction changing air chambers $\mathbf{22B_1}$, $\mathbf{22B_2}$ and $\mathbf{22B_3}$, and is discharged to the atmosphere from the both sides of the web 10 after performing the supporting and drying function for the web 10.

Figure 4:
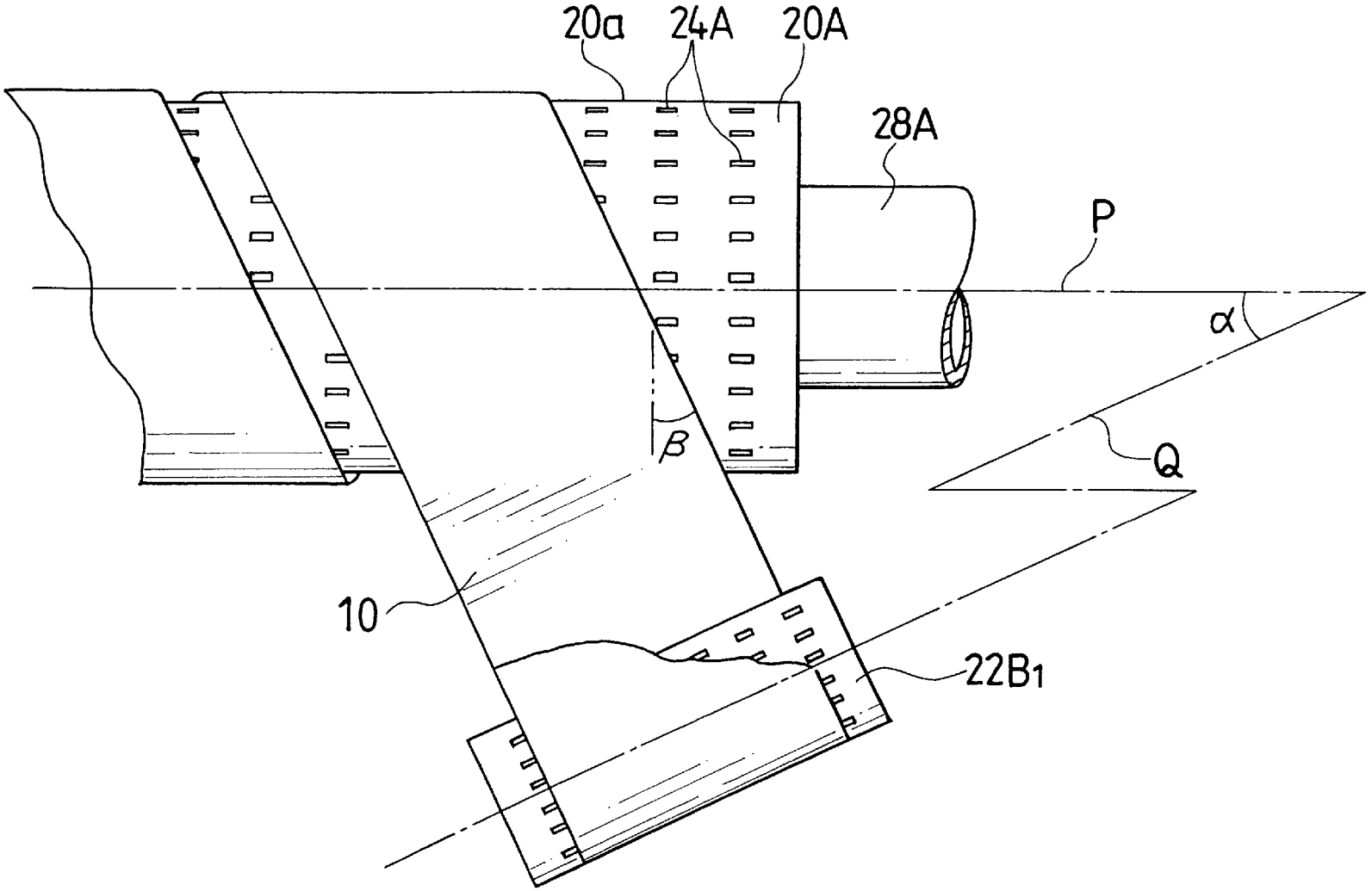
FIG. 4 is an explanation drawing showing the operation of the direction changing unit.

The direction changing unit 22B supports the web 10 so that the running direction of the web 10 when it leaves the cylindrical air chamber 20A is substantially parallel and opposite to that when the web 10 enters the cylindrical air chamber 20B. For example, as shown in FIG. 4, the direction changing air chambers $\mathbf{22B_1}$ and $\mathbf{22B_3}$ are arranged so that an angle $\alpha$ formed by an axis P of the cylindrical air chamber 20A and an axis Q of the direction changing air chamber $\mathbf{22B_1}$ and formed by an axis P of the cylindrical air chamber 20B and an axis Q of the direction changing air chamber $\mathbf{22B_3}$ is the same as a helical angle $\beta$ of the helical routes of the cylindrical air chambers 20A and 20B ($\alpha=\beta$).

The direction changing air chambers $\mathbf{22B_1}$ and $\mathbf{22B_3}$ are inclined by a predetermined angle according to the helical angle $\beta$ of the helical routes of the cylindrical air chambers 20A and 20B. Meanwhile, the middle direction changing air chamber $\mathbf{22B_2}$ is horizontally arranged, and it can be inclined by an arbitrary angle by an inclining mechanism 30B, which is constructed as follows.

Figure 5:
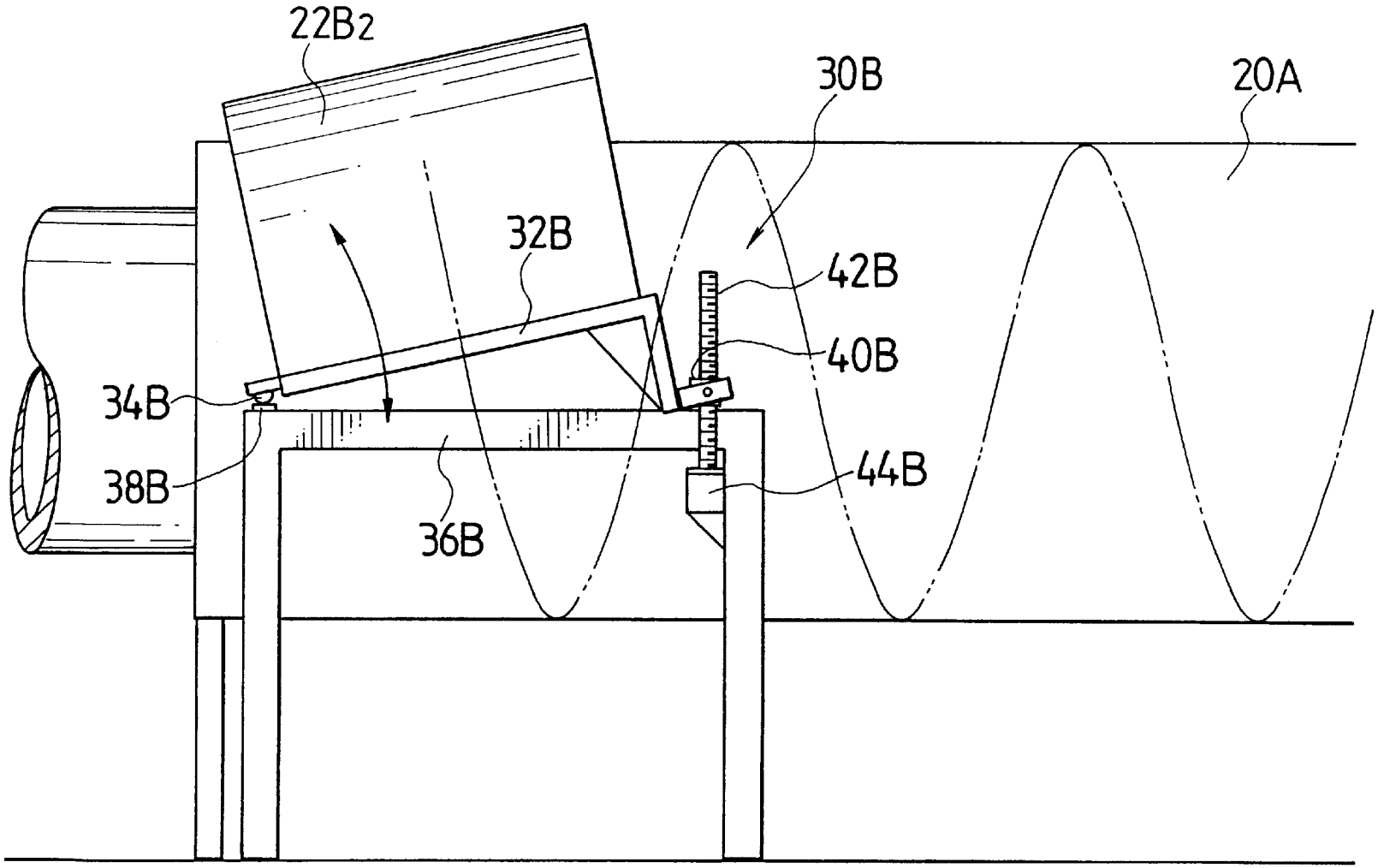
FIG. 5 is a front view showing the structure of an inclination mechanism.

As shown in FIG. 5, the middle direction changing air chamber $\mathbf{22B_2}$ is provided on an inclined frame 32B. A fulcrum 34B is provided at one end of the inclined frame 32B, and the fulcrum 34B is placed on a pad 38B provided on a supporting frame 36B. A nut member 40B is connected to the other end of the inclined frame 32B, and the nut member 40B is engaged with a vertical screw rod 42B. An output shaft of a motor 44B provided in the supporting frame 36B is connected to a base part of the screw rod 42B.

In the above-described inclining mechanism 30B, when the motor 44B is driven, the screw rod 42B is rotated and then the nut member 40B moves up or down according to the rotation amount of the screw rod 42B. Then, the inclined frame 32B is inclined about the fulcrum 34B, and thus the direction changing air chamber $22B_2$ is inclined.

The middle direction changing air chamber $22B_2$ can be inclined by the inclining mechanism 30B. The floatation rigidity value of the direction changing air chamber $22B_2$ is not less than that of the direction changing air chambers $22B_1$ and $22B_3$. A floatation rigidity value indicates a stability of a floating web; and the higher the floatation rigidity value is, the more stable the web is. The unit of the floatation rigidity value is kg/mm, and it indicates the tension of the web required for changing the floating amount of the web by 1 mm.

The direction changing unit 22B is constructed as described above. The other direction changing units 22A and 22C are constructed in the same way, and each of them comprises three direction changing air chambers, and middle direction changing air chambers $22A_2$ and $22C_2$ among the direction changing air chambers can be inclined by inclining mechanisms.

The middle direction changing air chambers $22A_2$, $22B_2$ and $22C_2$ among the direction changing air chambers of the direction changing units 22A, 22B and 22C can be inclined by arbitrary angles of inclination, however they are basically set horizontally. The other direction changing air chambers $22A_1$, $22A_3$, $22B_1$, $22B_3$, $22C_1$ and $22C_3$ may be omitted.

Also, the direction changing air chambers $22A_1$, $22A_3$, $22B_1$, $22B_3$, $22C_1$ and $22C_3$ may be horizontal and the middle direction changing air chambers $22A_2$, $22B_2$ and $22C_2$ may be set at the angle $\beta$.

Figure 6:
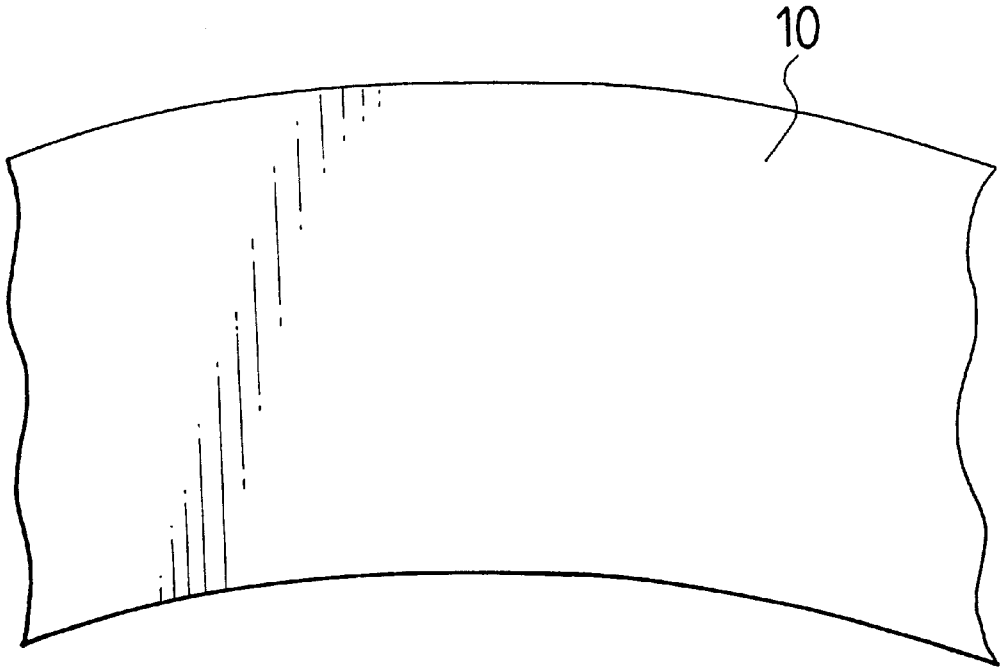
FIGS. 6(*a*) and 6(*b*) are plan views showing webs on which an arc stretch and a one-edge stretch occur.
Figure 6:
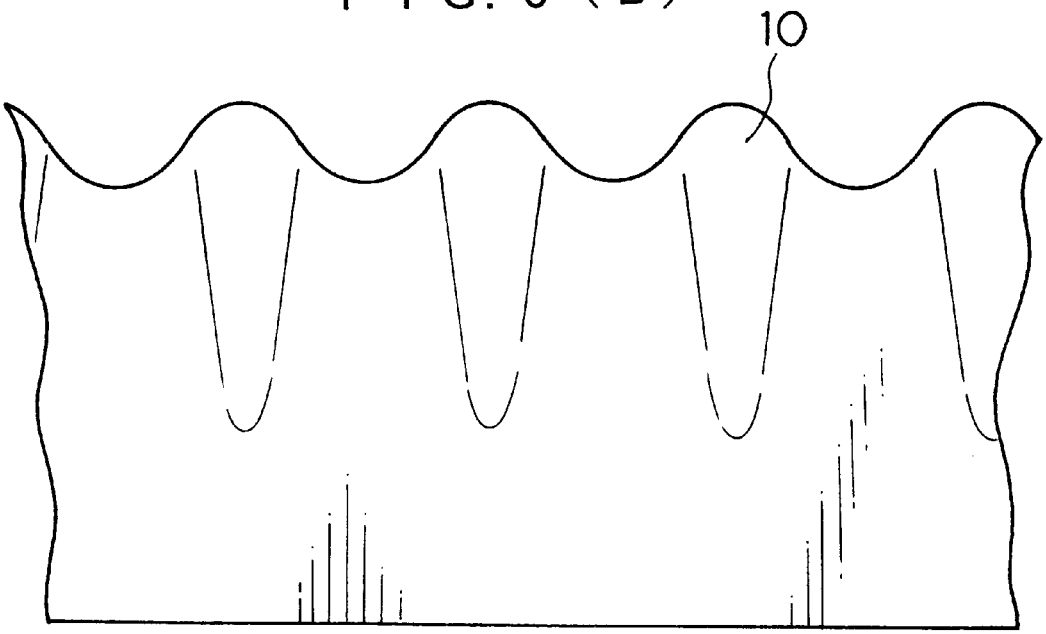

However, when the middle direction changing air chambers $22A_2$, $22B_2$ and $22C_2$ are horizontally set, the running web 10 can snake if an arc stretch (FIG. 6(*a*)) or a one-edge stretch (FIG. 6(*b*)) occurs on the web 10.

In the noncontact transporting apparatus 16 of the embodiment, if each direction changing unit has three direction changing air chambers, the middle direction changing air chambers $22A_2$, $22B_2$ and $22C_2$ are inclined by a predetermined angle according to the arc stretch or the one-edge stretch that is occurring on the web 10. Of course, when each direction changing unit has one direction changing air chamber, the direction changing air chambers are inclined.

The arc stretch and the one-edge stretch are generally detected according to the difference between tensions at both edges of the web 10. In the noncontact web transporting apparatus 16 of the embodiment, the middle direction changing air chambers $22A_2$, $22B_2$ and $22C_2$ are inclined according to the difference between tensions at both edges of the web 10. As shown in FIG. 1, a tension determining apparatus 50 that determines the tensions at both edges of the web 10 is provided above the noncontact transporting apparatus 16.

Figure 7:
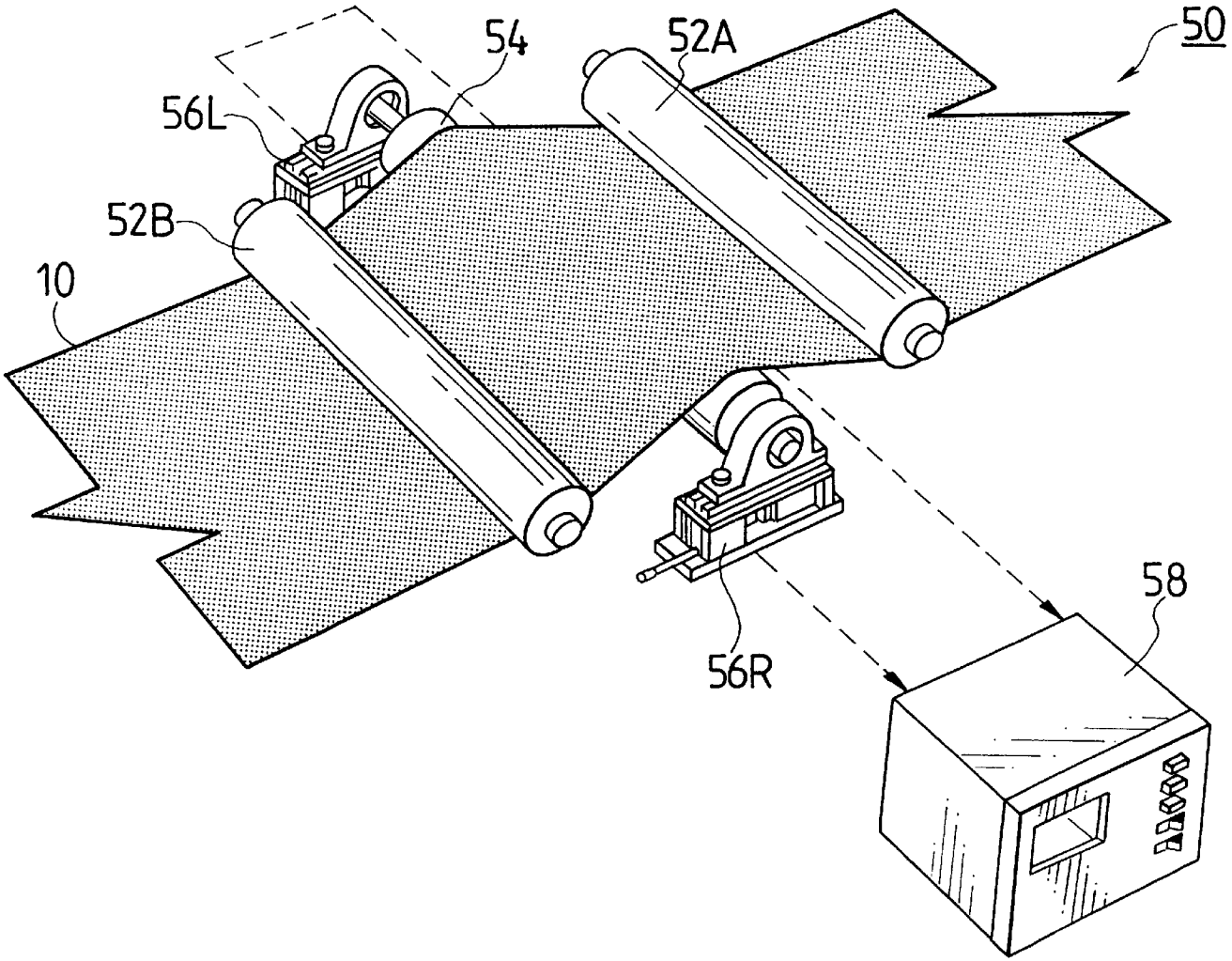
FIG. 7 is a perspective view showing the structure of a tension determining apparatus.

As shown in FIG. 7, the tension determining apparatus 50 comprises a pair of guide rollers 52A and 52B and a tension determining roller 54 arranged between the guide rollers 52A and 52B. The tensions at both edges of the web 10 on the tension determining roller 54 are determined by sensors 56R and 56L arranged at both ends of the tension determining roller 54, and are outputted to a controller 58. The controller 58 finds the difference between the tensions at both edges of the web 10 determined by the sensors 56R and 56L, and inclines the direction changing air chambers $22A_2$, $22B_2$ and $22C_2$ positioned at reference positions according to the difference.

The first embodiment of the coating and drying apparatus for the photosensitive material in which the above-described noncontact transporting apparatus according to the present invention is incorporated will now be explained.

First, the end of the web 10 is sent out from the sending-out roller 12, and the web 10 is wound along the transportation route and is fixed to the take-up roller 18. The middle direction changing air chambers $22A_2$, $22B_2$ and $22C_2$ of the direction changing units 22A, 22B and 22C of the noncontact transporting apparatus 16 are horizontally set.

Then, the arc stretch and the one-edge stretch are detected by the tension determining apparatus 50 according to the difference between the tensions at both edges of the web 10. Then, the controller 58 inclines the middle direction changing air chambers $22A_2$, $22B_2$ and $22C_2$ of the direction changing units 22A, 22B and 22C according to the detection result. For example, in FIG. 3, if the tension at the right edge of the web 10 is lower than that at the left edge, the middle direction changing air chambers $22A_2$, $22B_2$ and $22C_2$ of the direction changing units 22A, 22B and 22C are inclined clockwise by a predetermined angle; and if the tension at the right edge of the web 10 is higher than that at the left edge, the middle direction changing air chambers $22A_2$, $22B_2$ and $22C_2$ of the direction changing units 22A, 22B and 22C are inclined counterclockwise by a predetermined angle.

The direction changing units 22A, 22B and 22C are inclined according to the arc stretch and the one-edge stretch that is occurring on the web 10, and thus the bias and the snaking of the web 10 are reduced and the web 10 can run stably.

The angle of inclination of the middle direction changing air chambers $22A_2$, $22B_2$ and $22C_2$ of the direction changing units 22A, 22B and 22C is kept during the transportation of the web 10. This is because the arc stretch and the one-edge stretch are substantially constant over one roll of the web 10. By keeping the angle of inclination of the middle direction changing air chambers $22A_2$, $22B_2$ and $22C_2$ during the transportation of the web 10, the web 10 can run more stably. If the arc stretch and the one-edge stretch were detected during the transportation of the web 10 and the middle direction changing air chambers $22A_2$, $22B_2$ and $22C_2$ were inclined according to the determination result, the inclination would shake the web 10 to cause the bias and the snaking of the web 10. Therefore, the angle of inclination of the middle direction changing air chambers $22A_2$, $22B_2$ and $22C_2$ is kept during the transportation of the web 10 without inclination of the middle direction changing air chambers $22A_2$, $22B_2$ and $22C_2$.

The angle of inclination of the middle direction changing air chamber of each direction changing unit is set when the end of the web 10 arrives at the direction changing unit. The web 10 is sent out from the sending-out roller 12 by the sending-out apparatus (not shown). The web 10 sent out from the sending-out roller 12 is coated with the photosensitive material by the coating apparatus 14, and the photosensitive material is dried while the web 10 is transported without being contacted with by the noncontact transporting apparatus 16. Then the web 10 is taken up on the take-up roller 18 by the takeup apparatus (not shown). The web 10 can run stably due to the operation of the noncontact transporting apparatus 16 of the present embodiment.

According to the coating and drying apparatus for the photosensitive material in which the above-described noncontact transporting apparatus of the present invention is incorporated, the web 10 can run stably without the bias and the snaking.

In the embodiment, the inclining mechanism supports one end of the middle direction changing air chamber at the fulcrum and inclines the direction changing air chamber by moving up or down the other end of the direction changing air chamber by the screw mechanism; however, the inclining mechanism is not limited to this. For example, the center of the direction changing air chamber may be supported by a pin or the like so that it can swing and one end of the direction changing air chamber may be moved up or down by a screw mechanism, and a cylinder or the like may be used in stead of the screw mechanism.

Figure 8:
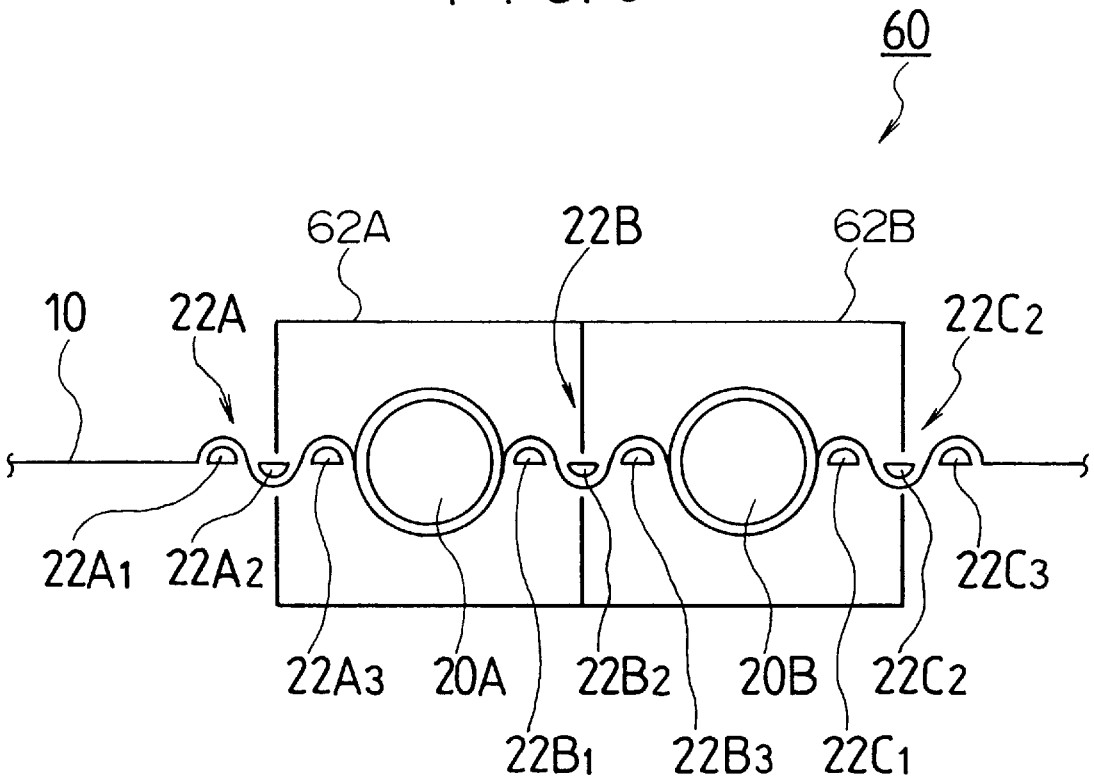
FIG. 8 is a side view showing the structure of the noncontact transporting apparatus according to a second embodiment.

FIG. 8 is a side view showing a second embodiment of the noncontact transporting apparatus according to the present invention.

As shown in FIG. 8, in a noncontact transporting apparatus 60 of the second embodiment, the cylindrical air chambers 20A and 20B are enclosed by partitions 62A and 62B, respectively. By enclosing the cylindrical air chambers 20A and 20B with the partitions 62A and 62B, the temperature and humidity of the air for drying and supporting the web 10 can be easily controlled.

Figure 9:
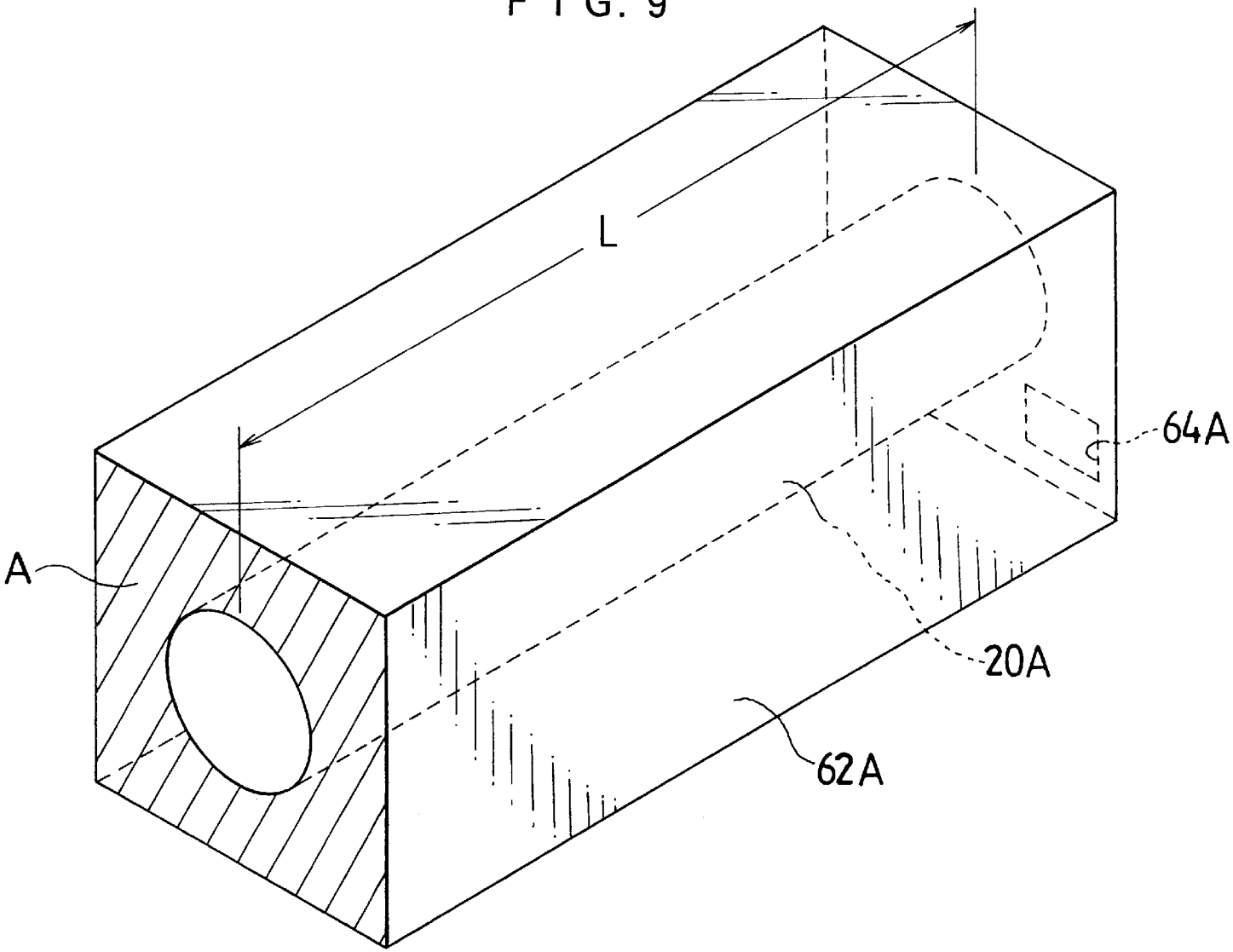
FIG. 9 is a perspective view showing the essential part of the noncontact transporting apparatus according to the second embodiment.

As shown in FIG. 9, outlets 64A and 64B (FIG. 9 shows only the suction holes 64A) are formed in the partitions 62A and 62B, respectively. The air jetted from the air jets 24A and 24B of the cylindrical air chambers 20A and 20B is discharged through the outlets 64A and 64B.

However, if the flow speed of the air to the outlets 64A and 64B is high when the cylindrical air chambers 20A and 20B are enclosed by the partitions 62A and 62B, the bias and the snaking of the web 10 that is running and floating around the cylindrical air chambers 20A and 20B occur.

Thus, it is required to enable the control of the temperature and humidity of the air for drying and supporting the web 10 and prevent the bias and the snaking of the web 10.

As shown in FIG. 9, the length of the cylindrical air chambers 20A and 20B is L, and the cross-sectional area of the spaces between the cylindrical air chambers 20A and 20B and the partitions 62A and 62B, respectively, is A. The amount of the air jetted from the cylindrical air chambers 20A and 20B is in proportion to the length L.

If L/A is low, the spaces between the cylindrical air chambers 20A and 20B and the partitions 62A and 62B, respectively, are large, and thus the apparatus cost is high and the space efficiently is low. Meanwhile, if L/A is high, the spaces between the cylindrical air chambers 20A and 20B and the partitions 62A and 62B, respectively, are small, and thus the flow speed of the return air is high and it causes the bias and the snaking of the web 10. To lower the flow speed of the return air, the outlets 64A and 64B may be formed in the centers of the sides of the partitions 62A and 62B, respectively. In this case, L is reduced to half.

The partitions 62A and 62B are arranged so that L/A is within the range between 0.1 and 2.0 and is preferably within the range between 0.2 and 1.5.

By arranging the partitions 62A and 62B in this manner, it is possible to control the temperature and humidity of the air for drying and supporting the web 10 and to effectively prevent the bias and the snaking of the web 10.

In the embodiments, there are two cylindrical air chambers 20A and 20B, but the number of the cylindrical air chambers is not limited to two and three of four cylindrical air chambers may be applied to the present invention.

In the embodiments, the noncontact transporting apparatus according to the present invention is incorporated in the coating and drying apparatus for the photosensitive material; however, the present invention is not limited to this. The noncontact transporting apparatus according to the present invention may be applied to other apparatuses.

EXAMPLE

In the noncontact transporting apparatus of the first embodiment, a polyethylene terephthalate film with the thickness of 100 $\mu$m was transported with the tension of 10 kg/m at the speed of 200 m/min with cylindrical air chambers 20A and 20B that were 2.5 m in diameter and 20 m in length.

If the floatation rigidity value of the middle direction changing air chambers $\mathbf{22}A_2$, $\mathbf{22}B_2$ and $\mathbf{22}C_2$ of the direction changing units 22A, 22B and 22C was lower than that of the other direction changing air chambers $\mathbf{22}A_1$, $\mathbf{22}A_3$, $\mathbf{22}B_1$, $\mathbf{22}B_3$, $\mathbf{22}C_1$ and $\mathbf{22}C_3$ (the floatation rigidity value of the middle direction changing air chambers $\mathbf{22}A_2$, $\mathbf{22}B_2$ and $\mathbf{22}C_2$ was 0.5 kg/mm, and the floatation rigidity value of the other direction changing air chambers $\mathbf{22}A_1$, $\mathbf{22}A_3$, $\mathbf{22}B_1$, $\mathbf{22}B_3$, $\mathbf{22}C_1$ and $\mathbf{22}C_3$ was 1.0 kg/mm), the snaking amount of the web 10 was 80 mm though the middle direction changing air chambers $\mathbf{22}A_2$, $\mathbf{22}B_2$ and $\mathbf{22}C_2$ were inclined. On the other hand, if the floatation rigidity value of the middle direction changing air chambers $\mathbf{22}A_2$, $\mathbf{22}B_2$ and $\mathbf{22}C_2$ was higher than that of the other direction changing air chambers $\mathbf{22}A_1$, $\mathbf{22}A_3$, $\mathbf{22}B_1$, $\mathbf{22}B_3$, $\mathbf{22}C_1$ and $\mathbf{22}C_3$ (the floatation rigidity value of the middle direction changing air chambers $\mathbf{22}A_2$, $\mathbf{22}B_2$ and $\mathbf{22}C_2$ was 1.5 kg/mm, and the floatation rigidity value of the other direction changing air chambers $\mathbf{22}A_1$, $\mathbf{22}A_3$, $\mathbf{22}B_1$, $\mathbf{22}B_3$, $\mathbf{22}C_1$ and $\mathbf{22}C_3$ was 1.0 kg/mm), the snaking amount of the web 10 was not more than 20 mm.

In the noncontact transporting apparatus of the second embodiment, a polyethylene terephthalate film with the thickness of 100 $\mu$m was transported with the tension of 10 kg/m at the speed of 200 m/min with the cylindrical air chambers 20A and 20B that were 2.5 m in diameter and 20 m in length and were enclosed by the partitions 62A and 62B that were 6 by 6 meters.

$L=20$ and $A=(6\times6)-(\pi\times2.5^2/4)=31.1$, and thus $L/A=0.6$. In this case, the snaking amount of the web 10 was 80 mm, and the web 10 could run stably. When the cylindrical air chambers 20A and 20B were enclosed by the partitions 62A and 62B that were 4 by 4 meters, $L/A=2.7$ and the snaking amount of the web 10 rose to 100 mm due to the return air.

As set forth hereinabove, according to the noncontact web transporting apparatus, the direction changing air chambers are inclined by the predetermined angle according to the tensions at both edges of the web. Therefore, the snaking and the bias of the web are prevented, and the web can run stably.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A noncontact web transporting apparatus, comprising:

at least two cylindrical air chambers which support a web running along helical routes through air films without coming into contact with the web by jetting air from jets formed in peripheries of the at least two cylindrical air chambers, the at least two cylindrical air chambers being substantially arranged parallel;

direction changing air chambers which support the web through air films by jetting air from jets formed in peripheries of the direction changing air chambers to change running directions of the web when the web enters and leaves the helical routes of the at least two cylindrical air chambers, the direction changing air chambers being arranged in rows at both ends of the at least two cylindrical air chambers;

a tension determining device which determines tensions at both edges of the web before the web enters the helical routes of the at least two cylindrical air chambers, the tension determining device being arranged above the at least two cylindrical air chambers; and an inclining device which inclines the direction changing air chambers according to determination results of the tension determining device.

2. The noncontact web transporting apparatus as defined in claim 1, wherein:

the at least two cylindrical air chambers are separately enclosed by partitions; and L/A is within the range between 0.1 and 2.0, where A is a cross-sectional area of spaces enclosed by the partitions and L is a length of the at least two cylindrical air chambers.

3. A noncontact web transporting apparatus, comprising:

at least two cylindrical air chambers which support a web running along helical routes through air films without coming into contact with the web by jetting air from jets formed in peripheries of the at least two cylindrical air chambers, the at least two cylindrical air chambers being substantially arranged parallel;

direction changing air chambers which support the web through air films by jetting air from jets formed in peripheries of the direction changing air chambers to change running directions of the web when the web enters and leaves the helical routes of the at least two cylindrical air chambers, the direction changing air chambers being arranged in rows at both ends of the at least two cylindrical air chambers, each of the rows having three direction changing air chambers;

a tension determining device which determines tensions at both edges of the web before the web enters the helical routes of the at least two cylindrical air chambers, the tension determining device being arranged above the at least two cylindrical air chambers; and an inclining device which inclines a middle direction changing air chamber in each of the rows of the three direction changing air chambers according to determination results of the tension determining device.

4. The noncontact web transporting apparatus as defined in claim 3, wherein:

the at least two cylindrical air chambers are separately enclosed by partitions; and L/A is within the range between 0.1 and 2.0, where A is a cross-sectional area of spaces enclosed by the partitions and L is a length of the at least two cylindrical air chambers.

* * * * *

UNITED STATES PATENT AND TRADEMARK OFFICE

CERTIFICATE OF CORRECTION

PATENT NO. : 6,257,520 B1
DATED : July 10, 2001
INVENTOR(S) : Daisuke Fujikura

It is certified that error appears in the above-identified patent and that said Letters Patent is hereby corrected as shown below:

Title page,
Item [73], Assignee: Fuji Photo Film Co., Ltd., Kanagawa (JP)

Signed and Sealed this

Fifth Day of February, 2002

*Attest:*

*Attesting Officer*

JAMES E. ROGAN
*Director of the United States Patent and Trademark Office*